United States Patent [19]

Pettengill

[11] Patent Number: 5,052,839

[45] Date of Patent: Oct. 1, 1991

[54] MASCARA APPLICATOR

[76] Inventor: Edwin R. Pettengill, 222B Shoshoni La., Stratford, Conn. 06497

[21] Appl. No.: 150,178

[22] Filed: Jan. 29, 1988

Related U.S. Application Data

[63] Continuation-in-part of Ser. No. 838,227, Mar. 6, 1986, abandoned.

[51] Int. Cl.[5] ..... A46B 11/00

[52] U.S. Cl. ..... 401/126; 401/10; 401/129

[58] Field of Search ..... 401/10, 129, 126

[56] References Cited

U.S. PATENT DOCUMENTS

| | | | |
|---|---|---|---|
| 741,722 | 10/1903 | Ryder et al. . | |
| 1,666,116 | 4/1928 | Bunnell | 401/10 |
| 2,022,896 | 12/1935 | Nathans | 401/10 |
| 2,323,595 | 7/1943 | Hanisch . | |
| 4,458,701 | 7/1984 | Holland | 132/88.7 |
| 4,600,328 | 7/1986 | Clements | 401/129 |

FOREIGN PATENT DOCUMENTS

| | | | |
|---|---|---|---|
| 820792 | 11/1951 | Fed. Rep. of Germany | 132/88.7 |
| 3240152 | 5/1984 | Fed. Rep. of Germany . | |
| 3610007 | 10/1987 | Fed. Rep. of Germany . | |
| 354335 | 10/1905 | France . | |
| 801333 | 8/1936 | France . | |
| 85037 | 12/1939 | France . | |
| 804192 | 11/1958 | United Kingdom | 132/88.7 |
| 2118436 | 11/1983 | United Kingdom | 132/88.7 |

*Primary Examiner*—Steven A. Bratlie

*Attorney, Agent, or Firm*—Melvin H. Kurtz; Daniel S. Ortiz

[57] ABSTRACT

A mascara applicator is described which comprises a reservoir for mascara containing dual side-by-side openings for the mascara and a handle integrally connected to two substantially straight application brushes which are adapted to be placed in the openings to receive mascara on the brushes, the handle having means to sealingly engage the reservoir.

10 Claims, 1 Drawing Sheet

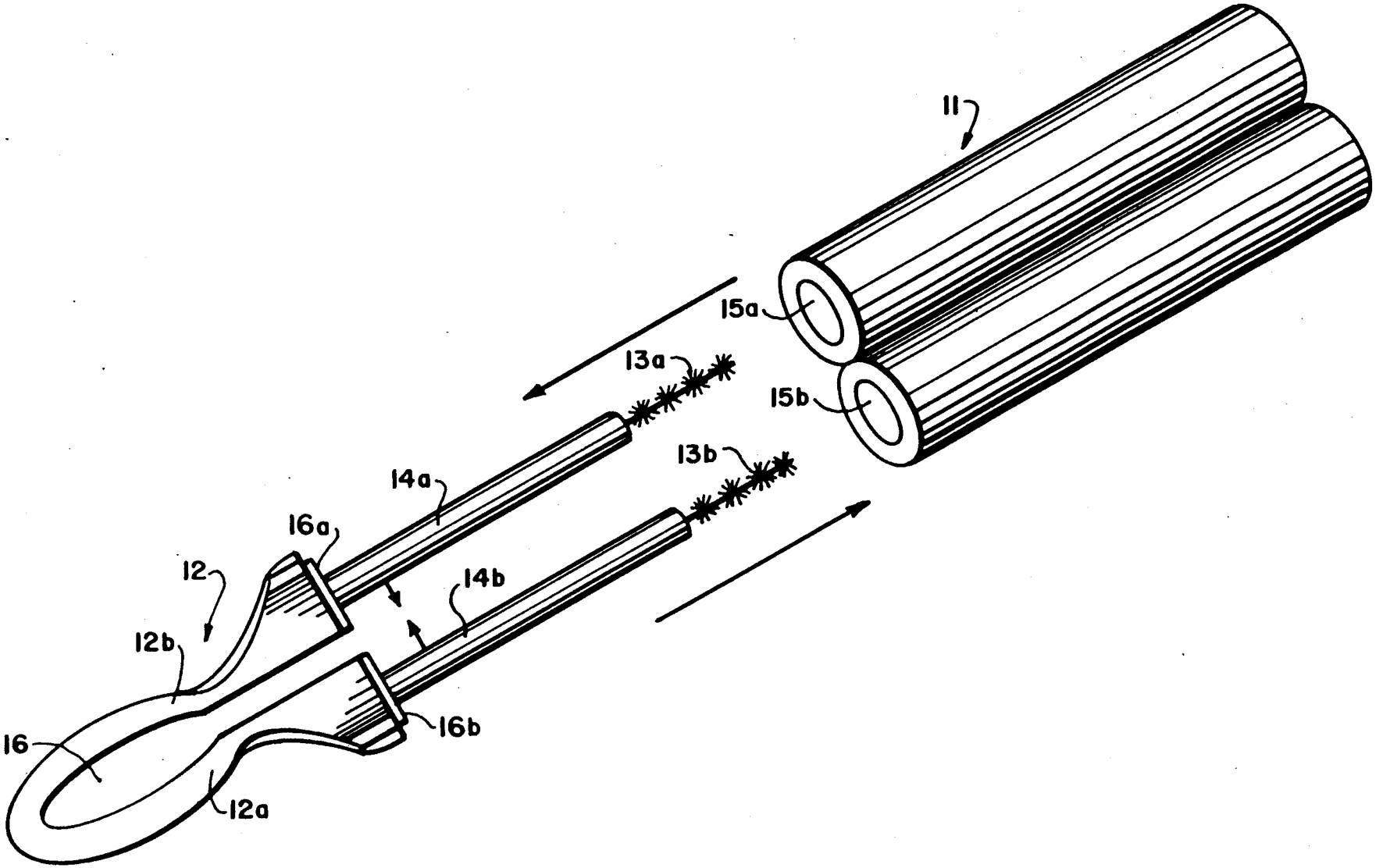
11
15a
15b
13a
13b
14a
14b
16a
16b
12
12a
12b
16

MASCARA APPLICATOR

RELATED APPLICATION

This application is a Continuation-in-Part of U.S. Serial No. 838,227 filed Mar. 6, 1986 now abandoned.

BACKGROUND OF THE PRESENT INVENTION

1. Field of the Invention

The present invention relates to a mascara applicator having a dual brush arrangement.

2. Description of the Prior Art

Recently, in U.S. Pat. No. 4,458,701 to L. Holland, a double brush mascara applicator was described. The mascara applicator of that invention comprised applicator tongs and a two-part carrying case with a mascara reservoir incorporated therein. The double brush tongs were made of a resilient material such that the brush members could receive eyelashes therebetween. The brushes were described as being of arcuate form so as to conform to the surfaces of the eyelashes. The applicator shown in this patent had a two-piece holder case. The top of the holder case enclosed the top portion of the tongs when not in use. The bottom of the holder served as a repository for the mascara. Thus, the device was of three-piece construction, i.e., the top of the holder case, the applicator tongs, and the bottom of the holder case.

SUMMARY OF THE PRESENT INVENTION

The present invention is an improved, more simple dual brush mascara applicator than the device shown in the Holland patent. It comprises only two separate pieces. The first is a reservoir for the mascara which has dual side-by-side openings. The second component is a handle which is integrally connected to two application brushes which are adapted to be placed in the openings of the reservoir to receive the mascara. The application brushes are substantially straight. The handle is preferably provided with means to sealingly engage the mascara reservoir and seal the openings to prevent drying of the mascara and leakage from the reservoir.

DESCRIPTION OF THE DRAWING

The present invention is further understood by reference to the Drawing wherein the Figure is a perspective view showing a mascara applicator in accordance with the present invention with the large arrows indicating the relative direction of movement of the reservoir and the handle between the position which each component has when the device is about to be used (as shown in the Drawing) and when it is not in use with the handle being stored in the reservoir (not shown).

DETAILED DESCRIPTION OF THE PRESENT INVENTION

As shown in the Figure, the mascara applicator of the present invention comprises a reservoir 11 and a handle 12 which is integrally connected to two application brushes 13*a* and 13*b* by brush support members 14*a* and 14*b*.

The brushes and support members 13 and 14 are both preferably substantially straight so that both are in substantially parallel side-by-side relationship to one another as shown in the Figure. The handle 12 is formed of a resilient material which allows for inward flexing of members 12*a* and 12*b* due to the presence of slot 16 to bring support members 14*a* and 14*b* and brushes 13*a* and 13*b* towards one another (as shown by the small arrows in the Figure) to simultaneously apply mascara to both surfaces of the eyelash.

The reservoir for the mascara contains dual side-by-side openings 15*a* and 15*b* which are each adapted to provide access to the mascara within. Preferably, the reservoir consists of two, generally cylindrical barrel portions joined together in side-by-side relationship, as shown in the Figure, each barrel portion containing an opening 15. In such a configuration, each opening 15*a* and 15*b* can be a discrete reservoir opening such that neither communicates with the other. This allows for each reservoir to contain a different type of mascara, if desired, without having such mascara products undesirably become mixed together with one another in the reservoir member 11. Alternatively, each barrel portion can be in communication with the other internally so that both brushes can contact a common reservoir of mascara.

The large arrows shown in the Figure illustrate the direction in which the handle and integrally connected brushes is moved between a position within the reservoir 11 or outside the reservoir 11. The shoulders 16*a* and 16*b* on the handle are adapted to sealingly engage the sides of openings 15*a* and 15*b* to prevent the mascara from escaping from the reservoir. In addition, the sealing engagment between the handle and the reservoir retards evaporation of the liquid components of the mascara. If desired, the openings 15*a* and 15*b* can contain either the same type of mascara or two differing types which are desired to be applied simultaneously to the eyelashes to give a pleasing cosmetic appearance thereto. As used herein, the term "mascara" is intended to cover any cosmetic substance which is adapted to be used to color or otherwise ornament the eyelashes.

The sealing engagment between the handle and the reservoir can be achieved by providing resilient means on the handle to enter the holes and seal them. The resilient means can be a resilient material from which the handle is fabricated. Resilient means such as grooves provided with 0 rings can be utilized. If the mascara is a solid or semi-solid composition, the sealing engagement can be provided by a close fit between the handle and the sides of the openings in the reservoir. A shoulder on the handle such as shown on the Figure at 16*a* and 16*b* provides an area larger than the perimeter of opening to provide additional sealing assistance.

The foregoing is intended to illustrate certain embodiments of the present invention and should not be construed in a limiting fashion. The scope of protection that is sought is set forth in the claims which follow:

I claim:

1. A mascara applicator which comprises:

(a) a reservoir for mascara containing dual, side-by-side openings; and (b) a handle comprising two spaced apart, resiliently connected elements, each element connected to an application brush adapted to be placed in the openings to receive mascara on the brushes, said handle and brushes having means to sealingly engage the reservoir to seal the openings and wherein when the brushes are withdrawn from the openings the brushes can be brought closer together by applying pressure to the elements.

2. An applicator as claimed in claim 1 wherein the handle is integrally connected to the application brushes by two substantially straight support members.

3. A mascara applicator as claimed in claim 1 wherein the handle is formed of a resilient material and comprises two flexible elements at least partially separated from one another by a slot.

4. A mascara applicator as claimed in claim 1 wherein the application brushes are each substantially straight.

5. A mascara applicator as claimed in claim 1 wherein the application brushes are each substantially straight and are connected to the handle by a substantially straight support member.

6. A mascara applicator as claimed in claim 1 wherein the handle is formed of a resilient material and comprises two flexible elements at least partially separated from one another by a slot, each of the flexible elements being joined to a support member for one of the brushes.

7. A mascara applicator as claimed in claim 1 wherein the reservoir comprises two barrel portions that are joined together, each of the barrel portions containing an opening.

8. A mascara applicator as claimed in claim 7 wherein each barrel is discrete and is not in internal communication with the other barrel.

9. A mascara applicator as claimed in claim 1 wherein the handle is formed of a resilient material and comprises two flexible elements at least partially separated from one another by a slot and wherein the application brushes are each substantially straight and are connected to the handle by a substantially straight support member.

10. A mascara applicator as claimed in claim 9 wherein the reservoir consists of two barrel portions, that are joined together, each containing an opening, each of the barrel portions being discrete and not in internal communication with the other.

* * * * *